United States Patent [19]

Kumagai

[11] 4,234,267

[45] Nov. 18, 1980

[54] DRAIN TRAP

[76] Inventor: Shigeto Kumagai, 7-13, Koyanagi-cho, 3-Chome, Fuchu-shi, Tokyo, Japan

[21] Appl. No.: 942,850

[22] Filed: Sep. 15, 1978

[30] Foreign Application Priority Data

Sep. 22, 1977 [JP] Japan ..... 52/114110
Oct. 31, 1977 [JP] Japan ..... 52/145020[U]

[51] Int. Cl.[3] ..... E02B 11/00

[52] U.S. Cl. ..... 405/42; 404/2; 405/43

[58] Field of Search ..... 405/39, 40, 41, 42, 405/43, 46, 47, 48, 51; 404/2, 4; 210/170

[56] References Cited

U.S. PATENT DOCUMENTS 914,231 3/1909 Booth ..... 404/2
1,687,782 10/1928 Norton ..... 405/43
4,024,716 5/1977 Duggins et al. ..... 405/43

*Primary Examiner*—Roy D. Frazier
*Assistant Examiner*—Alexander Grosz
*Attorney, Agent, or Firm*—Blum, Kaplan, Friedman, Silberman and Beran

[57] ABSTRACT

A drain trap comprises a plurality of flat water conveying plates with fine clearances therebetween and securely fixed to each other by ribs. Below said water conveying plates is fixed another water conveying plate of Y-shape in section having a water gathering passage and having fine clearances between the upper arms thereof and said flat plates, said flat plates and said Y-shaped plate being securely fixed to one another through further ribs. Said trap has a narrow end tightly engagable with a drain pipe through packing material.

10 Claims, 11 Drawing Figures

DRAIN TRAP

BACKGROUND OF THE INVENTION

The present invention relates to a drain trap to be laid underground for discharging water within the ground.

Hitherto drain pipes provided with a number of water gathering apertures distributed over the peripheral surfaces of said pipes have been used as drain traps. However, such drain pipes have the disadvantage that sand and earth, etc. are often apt to enter said water gathering apertures distributed on the peripheral surfaces of drain pipes together with subterranean water, so that the ground under which the drain pipes are buried, suffers serious erosion through said drain pipes over a period of years to form cavities around the buried drain pipes, such formation of cavities causing subsidence of ground surfaces or landslide. Moreover, dependent on the way in which water gathering apertures are formed, that is, the shape or the size thereof, apertures may be clogged so that the rate of drainage decreases and, furthermore, the boundary for gathering water under the ground through said water gathering apertures may also be decreased.

SUMMARY OF THE INVENTION

The present invention provides a drain trap which is effective for discharging subterranean water substantially free of earth, sands and the like, eliminating the danger of clogging said drain trap with said excluded material and broadens the area from which water is drained.

A drain trap according to the present invention comprises a plurality of flat water conveying plates hereinafter termed upper plates, combined radially with one another through ribs bracing said upper plates together. Said plates are provided with fine clearances therebetween at the inner edges thereof. Below the lower parts of said upper plates is disposed another water-conveying plate which is Y-shaped in section and hereinafter termed lower plate. Said lower plate has a water gathering passage at the upper portion thereof and is provided with fine clearances between the tips of said Y-shaped arms and the lower surfaces of said upper plates. Said flat upper plates and said Y-shaped lower plate are securely fixed to one another through further ribs, and the narrowed end of the combined plates are tightly engaged with a drain pipe containing packing material at clearances such as to exclude solid material in gathered water. Thereby said drain trap functions in such a manner that water gathered on said flat water conveying plates is collected while removing solid materials such as earth, sands and the like therefrom. The collected water passes through fine clearances formed between adjacently arranged water conveying plates and the water is discharged from the drain trap without suffering clogging with solid materials. The construction results in favourable effects of drainage of an extensive area due to provision of said water-conveying plates.

In a preferred form the number of flat plates in three, the plane of plate 1 being essentially vertical and the planes of the other two plates 2 and 3 forming dihedral angle as can be seen in FIG. 2, the planes of plates 2 and 3 sloping slightly to direct water collected by said plates toward slots 4 and thence to water-conveying channel 6. Also, the clearance of slots 8 formed by plates 2 and 3 with the arms of plate 7 is small enough to prevent passage of solid matter therethrough.

A drain trap according to the present invention may be provided with a water-conveying body of any desired length. This is achieved by providing a plurality of blocks capable of being combined with one another to form a water-conveying body.

A drain trap according to the present invention may further be provided with a water-conveying body composed of a plurality of water conveying plates and corresponding bracing ribs, said water conveying body having a screw threaded juncture to be engaged with a drain pipe, the structure being such as to eliminate any need for packing material therein and to prevent said water-conveying body from separating from the drain pipe after the drain trap has been laid under the ground.

DESCRIPTION OF THE PREFERRED EMBODIMENTS

Figure 1:
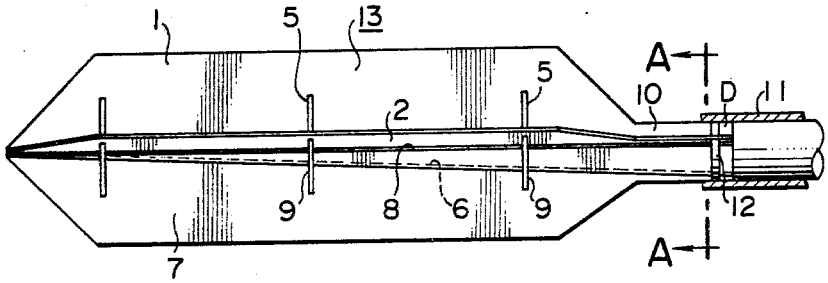
FIG. 1 is a side view of a drain trap according to the present invention.
Figure 2:
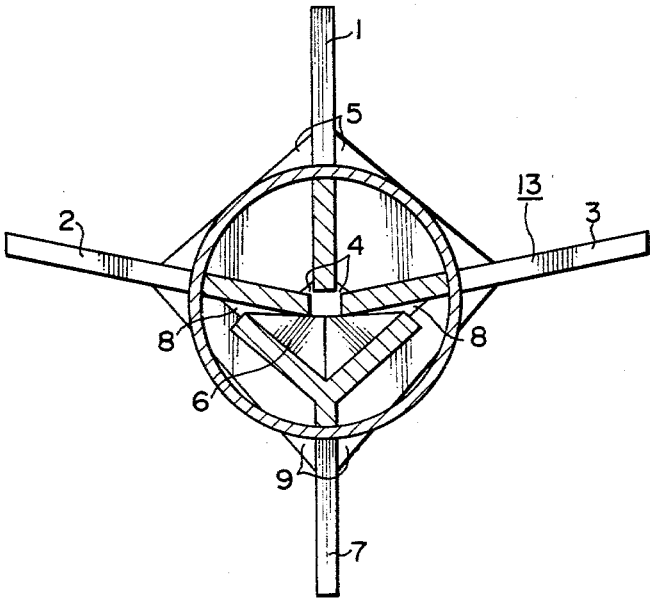
FIG. 2 is a cross sectional view in enlarged scale taken along line A—A of FIG. 1.
Figure 3:
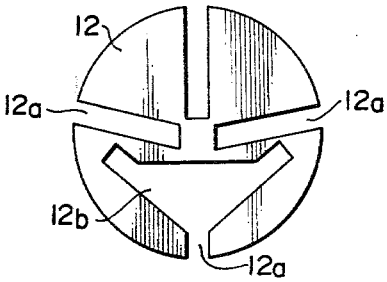
FIG. 3 is a front elevation of a packing to be used with a water-conveying body within a drain pipe.

A drain trap shown in FIG. 1 comprises a feather-shaped water-conveying body 13 having a narrow end 10 tightly engaged with a drain pipe 11. Portion D of said water-conveying body 13 is tightly engaged within said drain pipe 11 and is provided with a packing 12, also termed a packing plate, through which only water gathered by said water conveying body 13 can pass, solid matter being blocked by said packing. FIG. 2 is a cross sectional view taken along the line A—A of FIG. 1 and FIG. 3 is an elevational view of the packing plate 12. In each of the foregoing drawings, reference numerals 1, 2, 3 and 7 designate water conveying plates which are assembled to form a water conveying body 13 with fine clearances 4, 4 and 8, 8 therebetween. Flat plates 1, 2 and 3 and plate 7 which is Y-shaped in section are integrally welded together with bracing ribs 5, 5 and 9, 9. All of said plates are of the same length and communicate with said drain pipe 11 through said packing 12 shown in FIG. 3 so as to prevent water leaking out of said drain pipe 11 at the tightly engaged portion D of said body 13 with said drain pipe 11. Said packing 12 is made of a circular rubber disk as shown in FIG. 3 with deeply cut portions 12*a* for receiving said water conveying plates 1, 2, 3, and triangular aperture 12*b* for receiving plate 7 respectively at the narrow end 10. Water flows through aperture 12*b*. The outer diameter of said packing 12–15 is just large enough to fit the inner diameter of said drain pipe 11. With the foregoing assembly of the constituent elements said flat, essentially planar water-conveying plates 1 and 2 as well as 1 and 3 are adjacently disposed to each other so as to form narrow and long slots or clearances 4, 4 for gathering water as shown in FIG. 2, and said clearances 4, 4 are formed to be much narrower than apertures in conventional conduit pipes, so that granular earth and sands cannot pass therethrough, but water can flow through said granular earth and sands and said clearances 4, 4. Water then flows along the upper surfaces of water-conveying plate 7 which is Y-shaped in section and thence into drain pipe 11 through triangular aperture 12*b* of packing 12. The arms of the Y form a water-conveying passage. In order that collected water should flow smoothly toward, each drain pipe 11 the plates 1, 2, 3 and 7 are respectively formed with a downward inclination toward said drain pipe 11. When laying said water-conveying body 13 under the ground, said body must be oriented so that plate 1 is above plate 7.

The assembly of the water-conveying body 13 with the drain pipe is such that, the are from which water can be gathered can be extensive dependent upon the area in which said water conveying body is laid. The length and the boundary for gathering water is broadened remarkably as compared with a conventional water gathering pipe provided with a number of water gathering apertures distributed on the peripheral surface of said pipe. On the other hand, subterrenean water staying below the location of said water-conveying plates 2 and 3 is subjected to be raised along the water conveying plate 7 with the action of capillarity to reach onto the water conveying plate 7 through the clearances 8, 8, so that the effect for gathering water is enhanced considerably.

In the embodiment of FIGS. 4*a* to 4*c* and FIG. 5, a drain trap is shown which comprises a water conveying body 13 made up of three blocks 14, 15 and 16 which fit together.

Figure 4A:
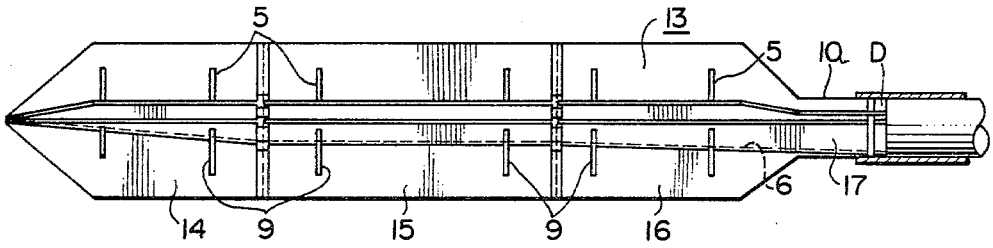
FIG. 4*a* is a side view of a drain trap comprising three blocks of water-conveying bodies in combination.

The outer end block 14 forms the head portion of water conveying body 13, while rear end block 16 illustrated in FIG. 4*a* comprises water conveying plates 1, 2, 3 and 7 as do blocks 14 and 15. Each of said water-conveying plates on end blocks 14 and 16 is provided with a recessed portion on the appropriate end surface thereof engageable with the oppositely facing end surface of the intermediate block 15. Each of the end surfaces of water conveying plates 1, 2, 3 and 7 constituting said intermediate block 15 is also shaped to be engageable with outer end block 14 and rear end block 16. The rear end block 16 forms the rear portion of the water conveying body 13, and the rearmost end 17 thereof is adapted to be connected to the interior of drain pipe 11 through the packing as in FIG. 1 and is shaped to transfer water into said drain pipe 11 from said fine clearances 4, 4 and 8, 8 respectively formed between said water conveying plates 1, 2, 3 and 7. Each of the shaped portions engageable with one another provided at the end of each water-conveying plate is formed in a strip-like configuration arranged transversely on each of said plates and provides very tight connection with one another, so that such troubles and defects as breaking of said water conveying body under the ground or discontinuity of water conveyance will never occur.

The engagement of blocks with one another need not be limited to the engagement of shaped end portions, but the connection by using a bonding agent is applicable to the present invention provided that the connection made with a bonding agent can prevent the foregoing drawbacks and defects such as breaking of the water-conveying body at the engaged juncture thereof and leakage of water due to discontinuity.

Figure 4B:
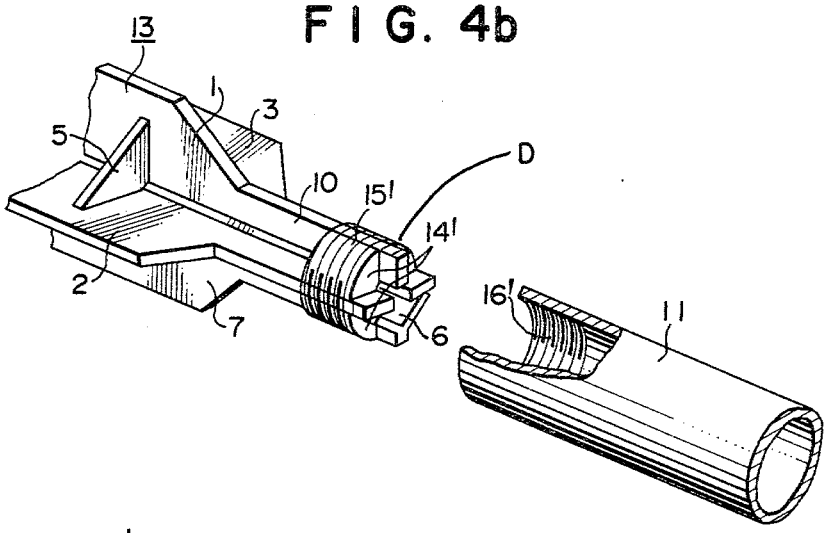
FIG. 4*b* is an enlarged exploded perspective view of another embodiment of a tightly engaged portion D in combination with a block.

FIG. 4*b* illustrates an embodiment of the tightly engaged portion D shown in FIG. 4*a* which is effective for preventing rupture at the juncture between the drain pipe 11 and the narrow portion 10 caused by torsion or distortion originated from unbalance of earth pressure when the drain trap is laid under the ground.

The drain trap of FIG. 4*b* comprises a water-conveying body 13 composed of water conveying plates 1, 2, 3 and 7 which are braced together with ribs 5 and 9 as shown in FIG. 4*a*. As shown in FIG. 4*b*, said water-conveying body 13 is joined with screw engagement between the externally threaded zone 15' at the narrow portion 10 of said water conveying body 13 and the internally threaded zone 16' of the drain pipe 11. The quadrants 14' block said matter from flowing along the upper surfaces of plates 1 and 3 and prevent entry of solid matter from below the upper plates into pipe 11 and thereby constitute a packing plate, eliminating need for a separate packing plate.

Reference numeral 14' represents a quadrant sector member securely fixed to narrow portion 10 of said water conveying body 13. The four quadrants are fitted around said narrow portion 10, each of said quadrants connecting the water conveying plates 1 with 2, 2 with 7, 7 with 3 and 3 with 1. Also, fine clearances are formed between corresponding plates by said quadrants and replace bracing ribs 5, 5 and 9, 9 successfully. On the outer peripheral surfaces of said four quadrantal members 14'—14' and on the outer peripheral surfaces of said water-conveying plates 1, 2, 3 and 7 are provided external thread 15' while on the inner surface at the end of drain pipe 11 which connects with water-conveying body 13 is provided internal thread 16' to be meshed with said external thread 15'. The screw engagement between said external thread 15' and said internal thread 16' is purposely made slightly loose in order to avoid breaking of narrow portion 10 such breakage being caused by torsion or distortion brought about under the unbalanced condition of the subterranean pressure when the drain trap is buried. The diameter of the external thread 15' is made only somewhat smaller than the diameter of the internal thread 16' so as to prevent said external threaded zone 15' from separating from said internal threaded zone 16'. In an extension of said method of engaging body 13 with drain pipe 11, drain pipe 11 may have a circular opening perforated on one side of same. Said opening being threaded with a female screw so as to connect said water-conveying body 13 with said drain pipe 11 at one side thereof by meshing the male screw 15' of said water conveying body 13 with the female screw of said drain pipe 11, whereby a number of water-conveying bodies 13 can be connected directly with a single drain pipe 11.

Such screw connections between the water conveying body and the drain pipe as set forth above can facilitate laying the drain trap underground and accelerate the drainage rate remarkably.

Figure 4C:
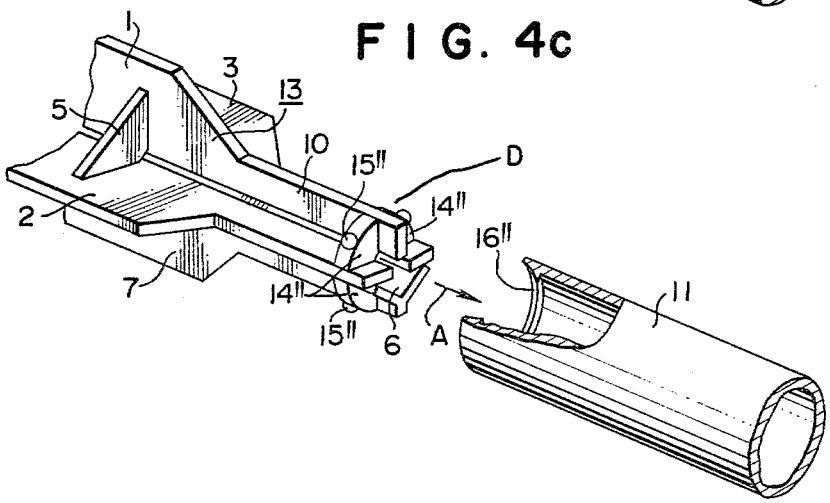
FIG. 4*c* is an enlarged exploded perspective view of another embodiment of a tightly engaged portion D.
Figure 5:
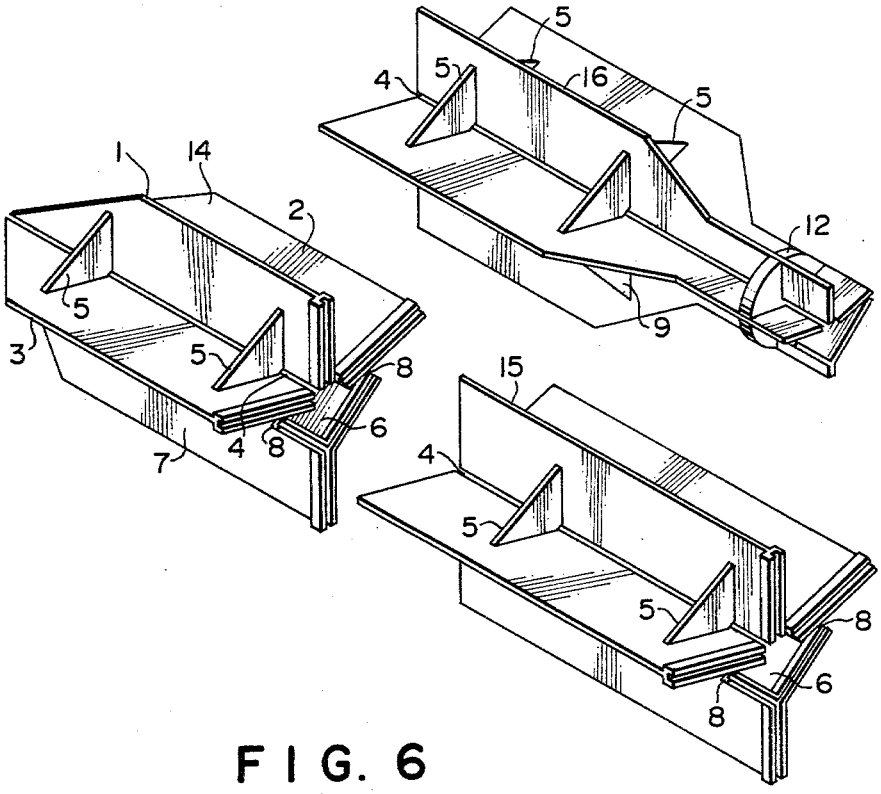
FIG. 5 is an enlarged exploded perspective view of a water-conveying body showing head, intermediate and rear blocks.

FIG. 4*c* shows another modification of a junction between water conveying body 13 at narrow portion 10 thereof and the drain pipe 11 at one end thereof according to the present invention, said junction is illustrated as a portion D in FIG. 4*a*.

The embodiment comprises a water conveying body 13 composed of upper water conveying plates 1, 2 and 3 and lower plate 7 which are braced together with ribs 5, 5 and 9, 9. The water conveying body 13 is inserted at the narrow portion 10 thereof into the drain pipe 11 excluding a packing 12.

Reference numeral 14″ designates four quadrant sector plates securely fixed to the water conveying body 13 at narrow portion 10 and connecting each of water conveying plates 1 with 2, 2 with 7, 7 with 3 and 3 with 1 and providing fine clearance between corresponding plates so as to take the part of bracing ribs 5, 5 and 9, 9 at said narrow portion 10. At the center of the outer peripheral surface of each of four sector plates 14″—14″, a small hemispherical protuberance 15″ is formed integrally with said sector plates 14″—14″, and on the inner end flange of drain pipe 11 to be connected with said water conveying body 13, is formed an engaging stepped shoulder 16″ of a hooked profile in section along the inner peripheral edge of said drain pipe 11. The inner diameter of said stepped shoulder 16″ is constructed to be slightly smaller than the diameter of the circumscribed circle over said small protuberances 15″, 15″ on said sector plates 14″—14″.

For connecting the water conveying body 13 with the drain pipe 11 which are constructed as set forth hereinbefore, the narrow portion 10 of said water conveying body 13 is forcedly inserted into said drain pipe 11 as is indicated by an arrow A, said small protuberances 15″—15″ formed on said sector plates 14″—14″ being deformed elastically so that said narrowed end can be advanced into the inner part of said stepped shoulder 16″ after said protruberances advance over said stepped shoulder 16″. After said advance, said protruberances are restored to their initial shapes, whereby said water conveying body 13 is prevented from separating from said drain pipe 11. In this instance, said small protruberances 15″—15″ are formed in such shapes having a dimension as small as possible for retaining said water conveying body 13 within said drain pipe 11 even though the former is forcedly pulled; thus the water-conveying body 13 is loosely connected under flexible engagement with said drain pipe 11.

The drain trap embodiment of FIGS. 4*a* to 4*c* and FIG. 5 as set forth hereinbefore shows an example of constructing a water conveying body 13 of three blocks 14, 15 and 16. The length of water-conveying body 13 may be extended to any desired value by combining a plurality of intermediate blocks 15 as required instead of a single block 15.

The water gathering passage 6 of said intermediate block 15 is formed horizontally as shown in FIG. 4*a* and said intermediate block 15 irrespective of the number to be employed can be connected with both end blocks requiring no staggering of the level of said water gathering passages between both end blocks. Accordingly, in order to avoid discontinuity of water conveyance as the water flows along said water gathering passage 6, said water conveying body 13 may be laid in a slight inclination under the ground.

The structure of the water conveying body according to the present invention as mentioned above provides advantages as set forth below:

(1) Only three kinds of blocks 14, 15 and 16 need be fabricated for connection with one another; thereby a water conveying body of any desired length and shape can be constructed to correspond to the boundary of the area to be drained.

(2) It is not necessary to manufacture a number of water conveying bodies having different lengths, but only three kinds of blocks need be fabricated from which water-conveying bodies of any desired length can be assembled at low cost of production.

Figure 6:
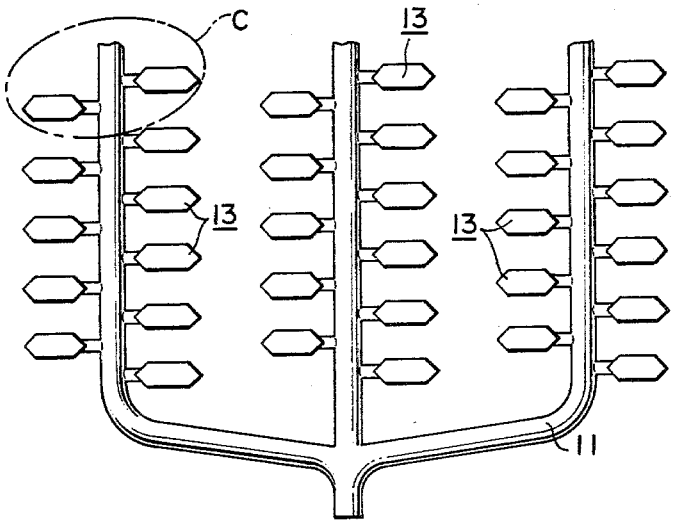
FIG. 6 shows schematically a horizontally laid out drain trap and pipe system.
Figure 7:
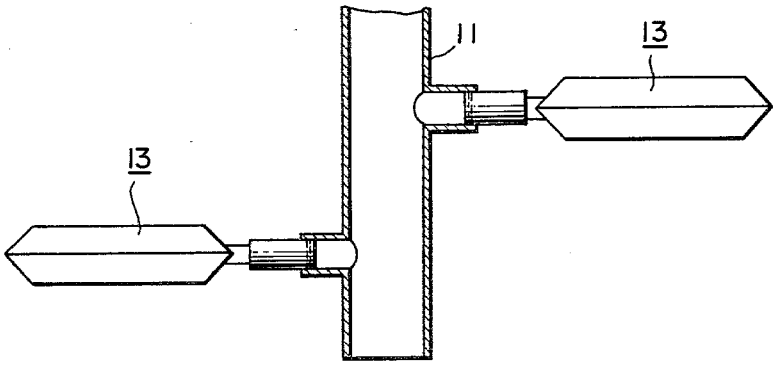
FIG. 7 is an enlarged vertical longitudinal sectional view in plan of encircled portion C of FIG. 6.
Figure 8:
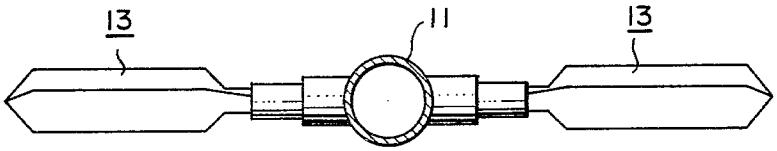
FIG. 8 is an enlarged horizontal longitudinal section in elevation of encircled portion C of FIG. 6.

FIGS. 6 to 8 exemplify horizontally laid drain traps according to the present invention, these being laid underground near the surface of the earth and said traps being assembled from a number of water conveying bodies 13 connected with a branch of a manifold drain pipe 11 at the alternately diametrical peripheral surfaces of each branched pipe. For instance, in case of a drain trap according to the present invention buried under a base-ball field, the entire area of the base-ball field can be quickly drained and reach a good condition ready for playing games. In this instance, said drain pipe 11 may be connected at the outlet thereof with a vacuum suction device; thus the action for gathering water from said water-conveying bodies can be accelerated to enhance the efficiency as well as the ability for gathering water to the utmost.

Figure 9:
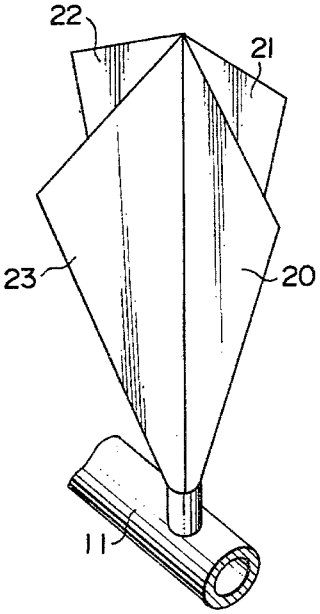
FIG. 9 is a perspective view of another embodiment of a water-conveying body.

FIG. 9 shows another embodiment of the water-conveying plate having a somewhat different shape from those shown in the previous examples. This last embodiment comprises an assembly of water-conveying plates connected with each other by welding to be disposed in the direction perpendicular to the surface of the earth. Underground water proximate said water-conveying plates 20, 21, 22 and 23 will flow along the surfaces on both sides of each plate to be discharged into the drain pipe 11 through clearances formed between adjacently arranged water conveying plates; thus the region from which said water-conveying plates gather water can be remarkably broadened.

What is claimed is:

1. A water-conveying structure for use in combination with a soil drainage system, including a water-conveying body comprising;

a plurality of essentially planar water-conveying plates also termed upper plates, each of said plates having a straight edge, said plates being radially arranged and disposed for forming narrow slots between said edges for permitting the passage of water therethrough while retaining solid matter;

a further water-conveying plate, termed lower plate, and having a Y-shaped section, the arms of said Y forming a water passage, said body being orientable in use for receiving in said water passage water flowing downwardly through said slots, each of said plates having a narrow end for insertion into a drain pipe and for joining said body to said drain pipe; said water passage having a downward slope toward said narrow end when said slots are oriented horizontally; each of said narrow ends having an outer edge; and packing plate means for blocking solid material from entry into said drain pipe, said packing plate means having therein radial apertures for receiving said narrow ends of said upper plates and an essentially triangular aperture for receiving said narrow end of said lower plate, and permitting flow of water from said water passage into said drain pipe, the periphery of said packing plate means being such that it can be inserted into said drain pipe for blocking entry of solid matter into said drain pipe.

2. The water-conveying structure of claim 1, further comprising drain pipe means having an end for receiving said narrow end of said body and said packing plate means, said narrow end of said body and said end of said drain pipe being shaped for being joined firmly and sealingly together.

3. The water-conveying structure of claim 1, further comprising ribs fixedly attached to said upper and lower plates for positioning same relative to each other and thereby establishing the clearance between said plates at said slots.

4. The water-conveying structure of claim 1, further including a head block and an intermediate block shaped at the ends thereof for joining together with said body, each of said head and intermediate blocks having a similar plurality of upper plates and a Y-shaped lower plate as said body, the water passages of said head block and said body being downwardly-sloped and the water passage of said intermediate block being horizontal and positionable to receive water from said head block and transfer water to said body, a body and blocks of any desired length being formable by joining a head block and a body to a selected number of intermediate blocks ranging from zero upwardly depending on the length of the area to be drained by said structure.

5. The water-conveying structure of claim 1, wherein said packing plate means are in the form of 4 quadrants firmly joining the narrow ends of said plates together, said quadrants and said edges of said narrow ends being shaped for joining said narrow ends firmly and sealingly to said end of said drain pipe means.

6. The water-conveying structure of claim 5, wherein said end of said drain pipe means is internally threaded and said packing plate means and said edges of said narrow ends are externally threaded to join firmly and sealingly with said end of said drain pipe means.

7. The water-conveying structure of claim 5, wherein said end of said drain pipe means has on the interior thereof a stepped shoulder and said packing plate means has on the periphery thereof a plurality of protrusions, the height of said protrusions being such that said narrow end cannot be freely inserted into said end of said drain pipe means, said protrusions being sufficiently deformable for permitting forcible entry of said narrow end through said stepped shoulder for forming a flexible, sealed junction with said drain pipe means, said stepped shoulder in section having a hooked profile for preventing removal of said narrow end of said body from said end of said drain pipe means.

8. The water-conveying structure of claim 1, further comprising drain pipe means in the form of a header and branch tubes, each of said branch tubes having an end for receiving and forming a firm and sealing junction with said narrow end of said body.

9. The water-conveying structure of claim 1, wherein said upper plates include a vertical plate and two nearly horizontal plates forming a shallow dihedral angle, the slope of said nearly horizontal plates being such as to direct water collected by said nearly horizontal plates toward said slots.

10. The water-conveying structure of claim 9, wherein the arms of said Y-shaped plate form with the undersides of said nearly horizontal plates further slots of fine clearance of permitting flow of water through said further slots into said water passage while blocking entry of solid matter into said passage.

* * * * *